US006830173B2

(12) United States Patent
Barber et al.

(10) Patent No.: US 6,830,173 B2
(45) Date of Patent: Dec. 14, 2004

(54) IMPACT DEVICE

(75) Inventors: John P. Barber, Dayton, OH (US); David P. Bauer, Xenia, OH (US); Robert C Cravens, II, Beavercreek, OH (US); David L. Remerowski, Cincinnati, OH (US)

(73) Assignee: Senco Products, Inc., Cincinnati, OH (US)

( * ) Notice: Subject to any disclaimer, the term of this patent is extended or adjusted under 35 U.S.C. 154(b) by 0 days.

(21) Appl. No.: 10/344,968

(22) PCT Filed: Aug. 24, 2001

(86) PCT No.: PCT/US01/26670

§ 371 (c)(1),
(2), (4) Date: Feb. 18, 2003

(87) PCT Pub. No.: WO02/16085

PCT Pub. Date: Feb. 28, 2002

(65) Prior Publication Data

US 2003/0183670 A1 Oct. 2, 2003

Related U.S. Application Data

(60) Provisional application No. 60/227,885, filed on Aug. 25, 2000.

(51) Int. Cl.[7] ..... B25C 1/06; H01H 47/32

(52) U.S. Cl. ..... 227/131; 173/117; 173/217; 310/27

(58) Field of Search ..... 227/10, 120, 130, 227/131; 173/117, 217; 310/27; 361/15, 155

(56) References Cited

U.S. PATENT DOCUMENTS 2,951,188 A 8/1960 Diebold et al.
2,976,907 A 3/1961 Harvey et al.
3,327,623 A 6/1967 Diegel
3,434,026 A 3/1969 Doyle
3,453,463 A 7/1969 Wildi
3,552,627 A 1/1971 Moreno
3,559,269 A 2/1971 Schmitt et al.
3,646,791 A 3/1972 Leftheris
3,695,130 A 10/1972 Fedrigo
3,704,506 A 12/1972 Orr et al.
3,730,039 A 5/1973 Fedrigo
3,731,370 A 5/1973 Leftheris
3,737,990 A 6/1973 Schutt
3,766,455 A 10/1973 Zakrewsky et al.
3,786,978 A 1/1974 Manganaro
3,811,313 A 5/1974 Schut
3,824,824 A 7/1974 Leftheris
3,924,789 A 12/1975 Avery et al.
3,945,109 A 3/1976 Leftheris (List continued on next page.)

OTHER PUBLICATIONS

Sieve, Low Voltage Electromagnetic Riveter, Society of Manufacturing Engineers, 1986.

* cited by examiner

*Primary Examiner*—Scott A. Smith
(74) *Attorney, Agent, or Firm*—Jerrold J. Litzinger

(57) ABSTRACT

An impact device (10) employing a novel direct electric propulsion system. The device operates by placing a conductive piston (23) adjacent to an electric coil (18) then rapidly releasing electrical energy stored in a capacitor (17) to energize the coil (18) and propel the piston according to the Lorentz force principal. The system can be designed for a wide range of drive energy, and offers several performance advantages over known propulsion systems. These advantages include simple construction and operation, low manufacturing costs, low drive energy variation, and the ability to adjust drive energy while over a wide range while maintaining low energy variation at reduced levels. The system is adaptable to be powered by either corded electric, or battery, or fuel cell.

36 Claims, 6 Drawing Sheets

U.S. PATENT DOCUMENTS 3,961,739 A 6/1976 Leftheris
4,005,812 A 2/1977 Doyle et al.
4,008,021 A 2/1977 Fedrigo et al.
4,015,671 A 4/1977 Borisov et al.
4,033,500 A 7/1977 Manganaro
4,091,260 A 5/1978 Leftheris et al.
4,128,000 A 12/1978 Hogenhout et al.
4,132,108 A 1/1979 Hogenhout
4,151,735 A 5/1979 McDermott
4,183,453 A 1/1980 Barrett et al.
4,230,249 A 10/1980 Nasiatka et al.
4,237,987 A 12/1980 Sherman
4,293,088 A 10/1981 Barrett et al.
4,300,282 A 11/1981 Bunyea et al.
4,305,541 A 12/1981 Barrett et al.
4,333,019 A 6/1982 Weigert
4,349,143 A 9/1982 Ewig
4,375,867 A * 3/1983 Novak et al. ..... 227/109
4,390,307 A 6/1983 Rice
4,409,007 A 10/1983 Torrey et al.
4,417,463 A 11/1983 Nelson
4,417,681 A 11/1983 Bernecki et al.
4,423,620 A 1/1984 Hogenhout et al.
4,449,161 A 5/1984 Kling
4,449,661 A 5/1984 Spehrley
4,491,260 A 1/1985 Jimena
4,491,262 A 1/1985 Ewig
4,500,936 A 2/1985 Dulin
4,500,938 A 2/1985 Dulin
4,511,074 A 4/1985 Kille et al.
4,513,188 A 4/1985 Katzenstein
4,515,303 A 5/1985 Schadlich et al.
4,524,897 A 6/1985 Bachmann
4,527,457 A 7/1985 Fikse
4,556,803 A 12/1985 Weigert
4,558,391 A * 12/1985 Ward et al. ..... 361/155
4,565,313 A 1/1986 Buck et al.
4,573,621 A 3/1986 Merkator et al.
4,573,624 A 3/1986 Muller et al.
4,611,742 A 9/1986 Rieker et al.
4,757,414 A * 7/1988 Barker et al. ..... 361/15
4,799,557 A 1/1989 Jacquemet
4,821,614 A 4/1989 Fleet et al.
4,836,008 A 6/1989 Weber
4,858,813 A 8/1989 Wingert
4,862,043 A * 8/1989 Zieve ..... 318/114
4,872,381 A 10/1989 Stroms
4,946,087 A 8/1990 Wingert
4,951,023 A 8/1990 Erd et al.
4,966,884 A 10/1990 Hilal
4,990,805 A * 2/1991 Zieve ..... 310/27
5,079,983 A 1/1992 Bruhn
5,122,506 A 6/1992 Wang
5,168,118 A 12/1992 Schroeder
5,222,012 A 6/1993 Frankeny et al.
5,280,673 A * 1/1994 Zieve et al. ..... 29/718
5,294,850 A 3/1994 Weh et al.
5,427,296 A 6/1995 Chen
5,431,083 A 7/1995 Vassioukevitch
5,437,094 A * 8/1995 Zieve et al. ..... 29/718
5,454,289 A 10/1995 Bacon et al.
5,458,043 A 10/1995 Jensen et al.
5,471,865 A 12/1995 Michaelewski et al.
5,483,863 A 1/1996 Dreizin
5,497,555 A 3/1996 Averbukh
5,540,134 A 7/1996 Bird
5,575,166 A 11/1996 Michaelewski et al.
5,577,315 A 11/1996 Givler
5,621,963 A 4/1997 Givler
5,666,715 A 9/1997 Zoiss et al.
5,671,879 A 9/1997 Lin
5,717,962 A * 2/1998 Sasaki et al. ..... 396/156
5,730,016 A 3/1998 Zittel
5,752,306 A 5/1998 Clark et al.
5,763,812 A 6/1998 Collins
5,774,968 A 7/1998 Givler
5,809,157 A 9/1998 Grumazescu
5,813,110 A 9/1998 Arntson
5,824,998 A 10/1998 Livshiz et al.
5,869,911 A 2/1999 Tanaka
5,924,350 A 7/1999 Helinski
6,074,360 A 6/2000 Haar et al.
6,142,131 A 11/2000 Wortman et al.

IMPACT DEVICE

CROSS REFERENCE TO RELATED APPLICATIONS

This application claims benefit from U.S. Provisional Patent Application Ser. No. 60/227,885, filed Aug. 25, 2000, which application is incorporated herein by reference.

BACKGROUND OF THE INVENTION

1. Field of the Invention

The present invention is directed in general to impact devices, and, in particular, to a novel propulsion system that allows simple construction with excellent tool attributes, safety, and performance. The benefits of the present propulsion system include a wide range of drive energy, low energy variance, and a high degree of energy level adjustment. The driving device also can be readily used with either a cord connected to traditional electric outlets or can also be powered by batteries or fuel cells.

2. Description of the Related Art

The powered fastening devices presented and discussed here are indirect acting in that they all propel a piston or driver which in turn drives the fastener into the target material. Meanwhile, direct acting tools propel the fastener directly—no piston or driver is used. Direct acting tools thus require high velocity to achieve the necessary kinetic energy and thus present a dangerous and potentially lethal safety problem. Also, the present invention is directed primarily to hand held tools. Of course, the present device could be mounted in a more elaborate automated, semi-automatic, or robotic system. Also, the present device is primarily directed to driving nails and staples. Variations on the fasteners to be driven or otherwise fixed include corrugated fasteners, screws, hog rings, clips, brads, pins, and the like.

The predominant design for powered fastening driving tools that are currently available are pneumatic. The materials to be joined are generally wood or wood products with attachment materials such as fabrics, plastics, felts, and light gauge metals. The fasteners are generally either nails or staples. In these tools, a piston is propelled by compressed air that is stored in a reservoir contained within the tool and released by a series of valves. The moving piston picks up a fastener from a collated storage magazine and drives the fastener into the target material. A compressed air source is required and is connected to the tool by a hose in order to recharge the reservoir. Pneumatic hand tool drive energy is generally limited to around 120 joules, as the tools get too large and bulky above this level. Energy variance is affected by the variance in air pressure supplied, while energy level adjustment is difficult by means of air pressure adjustment. Instead of pressure adjustment, drive energy is adjusted by mechanical means using an internal driver stop to absorb excess energy.

Powder (or propellant) actuated fastener driving tools are used most frequently for driving fasteners through attachment materials and into hard surfaces such as concrete, masonry, and steel. Many common types of this tool are single fastener, single shot devices; that are, a single fastener is manually inserted into the firing chamber of the tool, along with a single propellant cartridge. After the fastener is discharged, the tool must be manually reloaded with both a fastener and a propellant cartridge in order to be operated again. Examples of this tool are shown in U.S. Pat. Nos. 4,830,254; 4,598,851; and 4,577,793. Some powder actuated tools operate in a manner similar to traditional pneumatic tools in that they contain a magazine which automatically feeds a plurality of fasteners serially to the drive chamber of the tool, while a strip of propellant charges is supplied serially to the tool to drive the fasteners. Examples of this tool are taught in U.S. Pat. Nos. 4,821,938 and No. 4,655,380. Powder actuated tools require expensive cartridges which must be reloaded intermittently. Energy level capability with these tools is high, usually 200 joules and greater. The traditional combustion process cannot readily be run at reduced energy levels, as the reduction methods interfere with the optimum combustion parameters. In addition, drive energy variance increases as energy reduction increases.

Another example of prior art fastener driving tools involves the combustion of gaseous fuel to propel a piston. The combustion gas is stored in a disposable canister mounted on the tool and metered into the combustion chamber by valve means. The gas ignites by an electrical spark and then the expanding combustion products propel a piston, which picks up a fastener from the magazine and drives the fastener into the target material. The practical energy range is similar to pneumatic tools, around 120 joules maximum, as above this range hand held tools tend to get large and bulky. As in powder actuated tools, the combustion process cannot readily be run at reduced energy levels since the known reduction methods interfere with the optimum combustion parameters. Thus, for energy adjustment a mechanical stop means is used to reduce energy levels. An example of this type of prior art tool is U.S. Pat. No. 4,403,722.

Yet another method of propelling fasteners into target materials utilizes an electric motor, a flywheel as energy storage, and various release means. In one example, energy is transferred from the motor to a flywheel storage device. When the flywheel reaches the required rotary speed, and thus energy, a driver is introduced tangentially between the flywheel and an idler roller, and is pinched between the two and rapidly accelerated. The driver then picks up a fastener from the magazine and drives it into the target material by transfer of kinetic energy. One example of this type of prior art tool is shown in U.S. Pat. No. 4,323,127.

In another method that utilizes an electric motor, energy is stored in a flywheel and then released by a conical clutch means that propels a driver via a cable attachment. Fastener driving is the same process as in the other electric motor tool. This device is taught in U.S. Pat. No. 5,320,270. Both electric motor based propulsion systems are highly complex and are difficult to adapt to the rigors of an industrial environment while keeping the weight at a reasonable value for a hand held tool. Energy level control, obtained by controlling the motor speed, is excellent. The energy range attainable can be somewhat greater than pneumatic tools but does not rival powder actuated tools for hand held applications.

Another means for propelling fasteners using hand held tools utilizes a solenoid. Here the driver functions as the rod of the solenoid that is drawn into by the coil and thus propelled. The driver then collides with the fastener and drives it into the target material. Examples of this type of prior art tools are many: one of which is Sears catalog No. 9-27235. In another type of solenoid powered tool, a multistage coil is used. Here a solenoid rod is drawn into the first coil then a switch is engaged which activates a second coil. An example of this type of tool is Chinese Patent No. 2,321,594. There are several limitations to this propulsion system. First, the solenoid system consists of heavy components in both the iron rod and the copper coil windings.

The stroke of the solenoid is limited by the electric field of the coil and that, in turn, limits the length of fastener that can be driven. Since solenoids are not energy efficient devices, the energy level is limited to around 30 joules.

SUMMARY OF THE PRESENT INVENTION

Consequently, a need exists for a direct electric propulsion tool as a replacement for traditional combustion (gas or propellant), electric motor, solenoid or pneumatic tools.

It is an object of the present invention to provide a wide range of fastener driving energy that encompasses the sum of the prior art range.

It is further an object of the present invention to provide a simple and rugged design that is suitable for industrial and construction environments from both a survivability and maintainability view.

It is also an object of the present invention to provide a drive energy reduction means that allows the proper drive energy to be adjusted for a wide range of fasteners.

These and other objects of the present invention will be more readily apparent from the description and drawings below.

BRIEF DESCRIPTION OF THE DRAWINGS

The accompanying drawings, incorporated in and forming a part of the specification, illustrate several aspects of the present invention, and together with the description serve to explain the principles of the invention. In the drawings.

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
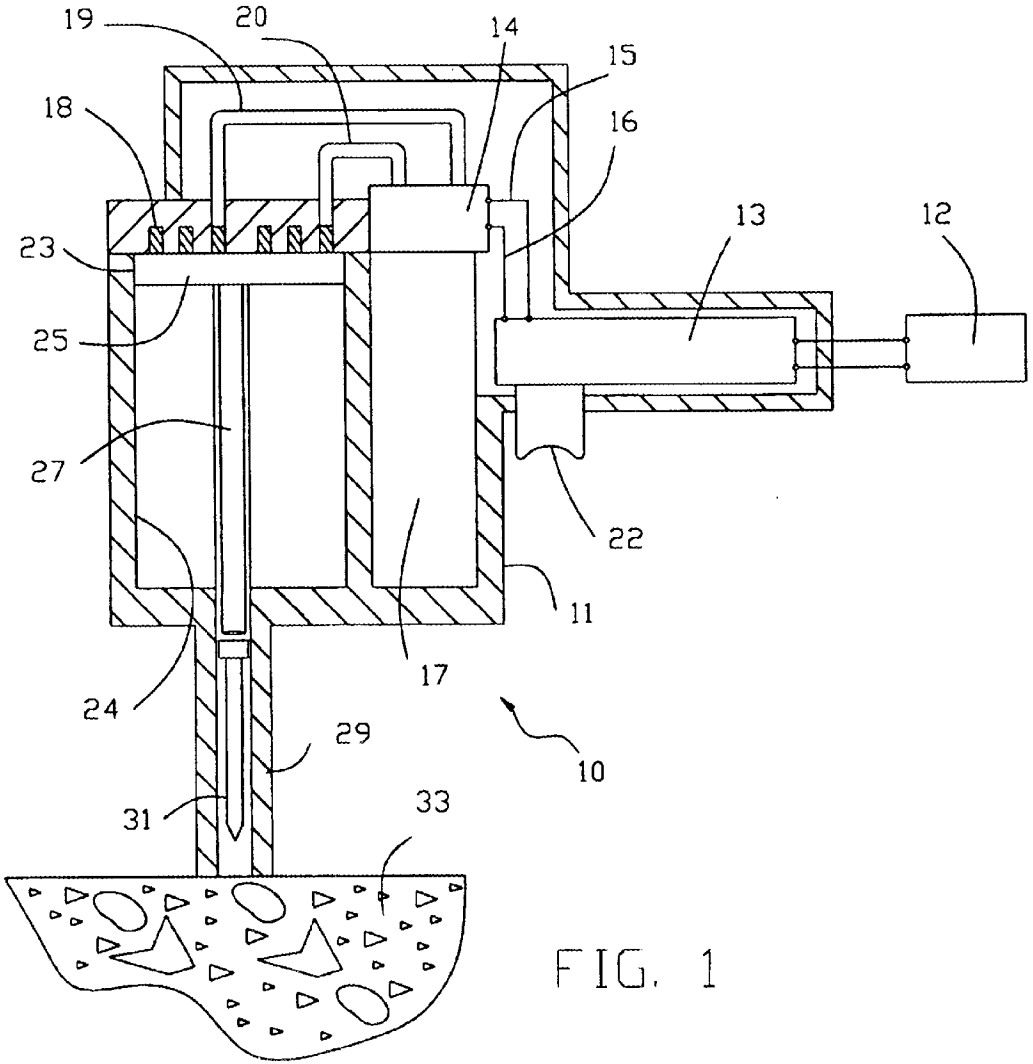
FIG. 1 is a sectional view of a tool for driving nails that is constructed according to the principles of the present invention.

Referring now to the drawings, FIG. 1 is a sectional view of a tool employing the principles of the present invention. The tool, generally designated at 10, consists of a housing 11 which contains the operating components of the tool. A power source 12 is coupled to tool 10, and may consist of either a battery, a fuel cell, or any traditional source of alternating current. Power source 12 is connected to a power supply/control board 13 within housing 11. For a battery power source, power supply/control board 13 converts the low voltage direct current of the battery to a suitable higher voltage. For an alternating current power source (AC), power supply/control board 13 rectifies the AC and transforms it to a suitable higher voltage. Power supply/control board 13 also acts to control a current switch assembly 14 that is connected to power supply/control board 13 by a pair of conductors 15 and 16. Current switch 14 controls the flow of energy between a capacitor 17 and a propulsion coil 18, with the current flowing via a pair of conductors 19 and 20. Switch 14 acts to control both the charging of capacitor 17 and also release of the energy stored in capacitor 17. A trigger switch 22 which is acuatable by the tool operator for controlling tool operations extends from housing 11 and is electrically coupled to power supply/control board 13.

Tool 10 also includes a drive piston assembly 23 which is slidably contained within a cylinder sleeve or bore 24 in housing 11. Piston assembly 23 is composed of a metal member 25 and a fastener driving member 27 which extends from piston 23 into bore 24 and is sized to slidably extend into and out of a drive track 29 within housing 11, where it can engage a fastener 31 to drive fastener 31 into a target material 33.

The tool operation of tool 10 will now be described. An operator positions tool 10 on target material 33 and then depresses trigger switch 22 which extends from housing 11. When trigger switch 22 is actuated, power supply/control board 13 actuates current switch 14 to release the energy stored in capacitor 17. As current travels through propulsion coil 18, eddy currents are induced in drive piston 23. The eddy currents repulse drive piston 23 from coil 18 according to the Lorentz force principle and propel drive piston 23 downwardly within bore 24. Driving member 27 of drive piston 23 contacts fastener 31 and drives it into target material 33.

Figure 4:
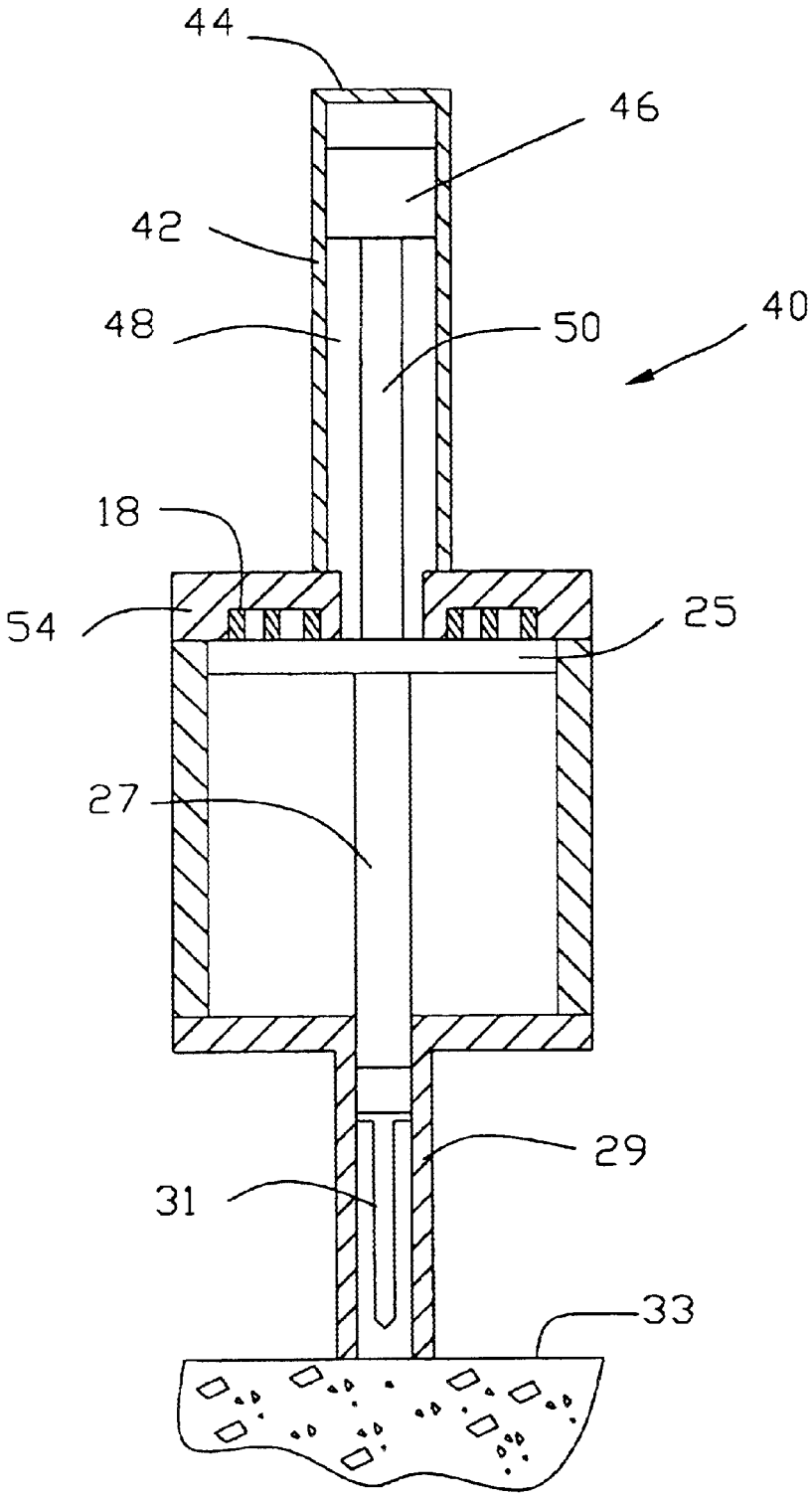
FIG. 4 is a sectional view of a return system for use in the present invention.
Figure 5:
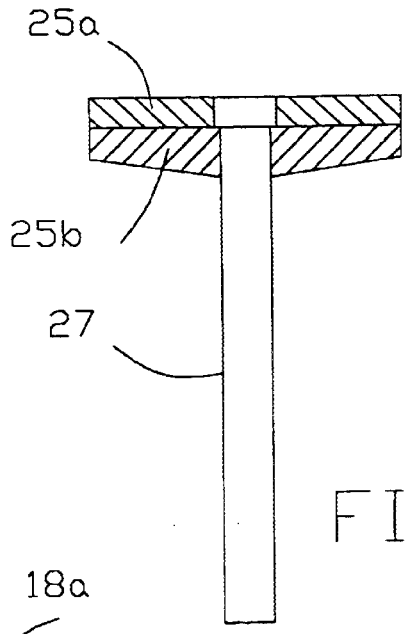
FIG. 5 is a sectional view of a piston for use in the present invention.

In this embodiment, drive piston 23 is returned to and maintained in contact with coil 18 by a vacuum operated spring assembly 40. Referring now to FIG. 4, assembly 40 contains a tubular cylinder 42 having a closed end 44 which guides a vacuum piston 46. A vacuum is established in interior 48 of cylinder 42. Vacuum piston 46 is connected to drive piston 23 by a coupling rod 50. In this embodiment, the connection is depicted as rod 50, but may also be a cable. As drive piston 23 is propelled, the vacuum acting on vacuum piston 46 applies a nearly constant force in the opposite direction. Thus, after drive piston 23 has transferred its kinetic energy during the drive cycle, vacuum spring assembly 40 returns the drive piston 23 to its original position and in intimate contact with the face of propulsion coil 18. Coil 18 is enclosed by a coil housing 54, as can be clearly seen in FIG. 5. The wire used to form coil 18 in the present invention preferably has a rectangular cross section, preferably square, which is more efficient in propelling piston 23 and also has a lower heat generation.

When the capacitor voltage is reduced during the nail drive, power supply/control board 13 uses energy from power source 12 to recharge capacitor 17. When the voltage in the capacitor 17 reaches its required voltage, the drive cycle can be repeated.

The design of drive piston 23 consists of metal piston member 25 and device member 27. Member 27 transfers the kinetic energy developed in drive piston 23 to fastener 31 being driven, much the same as in the prior art devices. However, the drive piston assembly 23 presents a design situation that is not encountered in prior art; that is, piston assembly 23 must be highly conductive and also not magnetic. Also, in order to improve efficiency and reduce tool recoil, the mass of drive piston 23 must be kept to a minimum. Highly conductive metals are usually weak materials, as the usual metallurgical techniques such as alloying or work hardening interfere with the electron paths in the crystalline structure. Thus, these highly conductive materials are nearly pure metals with low work hardening, such as pure aluminum and copper. However, the magnetic field generated by coil 18 can be as high as the equivalent to a pressure of 2000 psi, and thus generates large forces and subsequently large stresses. Thus, metal piston member 25 must be stronger than normal highly conductive metals. The design thus lends itself to a two piece construction. An example is a structure having a top section 25*a* that is formed from a highly conductive material, and a lower cup-like structure 25*b* that resists the high repulsive forces and transmits the energy through member 27. This structure can be clearly seen in FIG. 5. The material for the lower structure should be both non-magnetic and also have a high strength to weight ratio, such as titanium or aluminum alloys. A design alternative could also be a one-piece design wherein metal member 25 and driving member 27 are made into one part.

The strong electromagnetic field emanating from the coil affects material selection of the surrounding components. These components include the coil housing, the drive piston guide tube, and the shank that connects the drive piston to the vacuum piston. In order to attain efficiency in propelling the driver, the materials selected for these components must be essentially non-electrically conductive. If, for instance, the coil housing were to be fabricated from a conductive material such as aluminum, the field would be diverted into the coil and less would be available to propel the drive piston down the bore. Also, the current generated in the coil housing would result in wasteful resistive heating. Similar effects would result for other components in the coil area. Also, the large current flowing through the coil and induced in the drive piston top results in resistive heating in both. It is required of the components in contact with the coil and drive piston to withstand the heat generated from these components and also to conduct heat away from them. In addition, the reaction force from the repulsion of the piston acts on the coil housing and thus the coil housing material must have good strength and impact resistance. Material selections for the surrounding components include plastics and ceramics. Plastic material would be either thermosets such as epoxy, phenolic and polyester or thermoplastics such as polyester, polyimide, polysulfone, polyetherketone, polyamide, polyphenylene sulfide, liquid crystal polymers, polyetherimide, polyarylate, polycarbonate or other plastics and plastic alloys commonly known as engineering resins. These plastics could be modified with additives such as carbon and graphite to improve thermal conductivity or fibers to improve strength and toughness. Ceramic material selection would include silicon nitride, alumina, aluminum nitride, zirconia, silicon carbide, and ceramic alloys and composite materials. The thermal performance of ceramics can also be improved by addition of thermally conductive materials.

Figure 2:
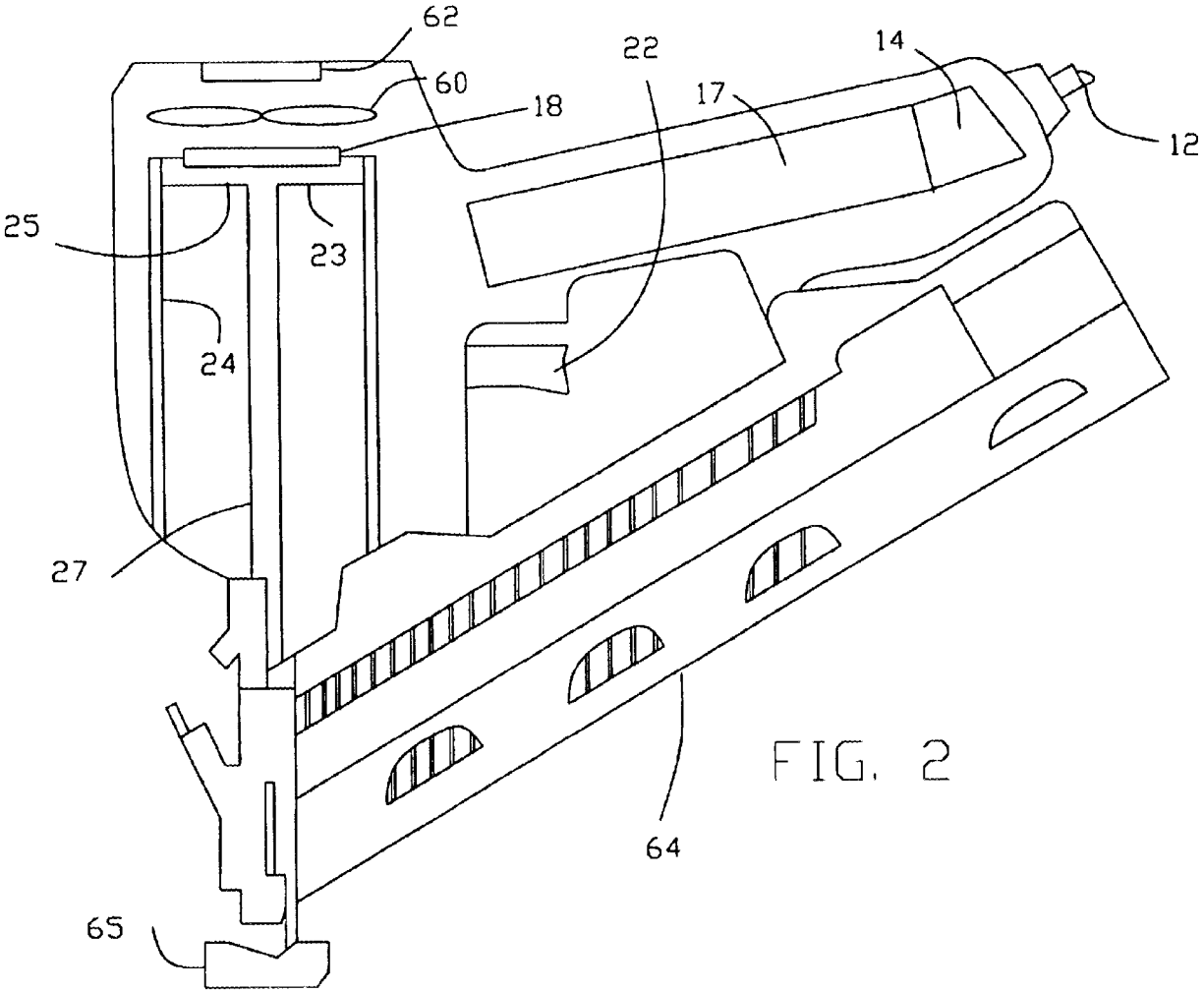
FIG. 2 is a sectional view of a tool for driving nails according to the principles of the present invention.

In FIG. 2, the present invention is depicted as a finish nailing tool. Several components which were not depicted in the tool of FIG. 1 appear in FIG. 2: a cooling fan 60, a fan motor 62, a magazine 64, and a workpiece responsive safety element 65. Cooling fan 60 and motor 62 are used to dissipate excessive heat from coil 18, when necessary. Magazine 64 is used to hold a collated strip of nails. Cooling fan 60 is sized to remove tool heat at a worst case scenario, as it is designed to operate at the maximum rate anticipated for its intended applications, while also operating under the worst ambient conditions. As it is desirable to operate tool 10 under battery power, it is important to conserve as much electrical energy as possible. Thus, a variable speed fan with only "as needed" operation is desirable to minimize electrical usage. A thermostatic control switch can be used to turn the fan on only when needed. Power supply/control board 13 could also be used to provide this operation for maximum battery energy conservation.

Figure 3:
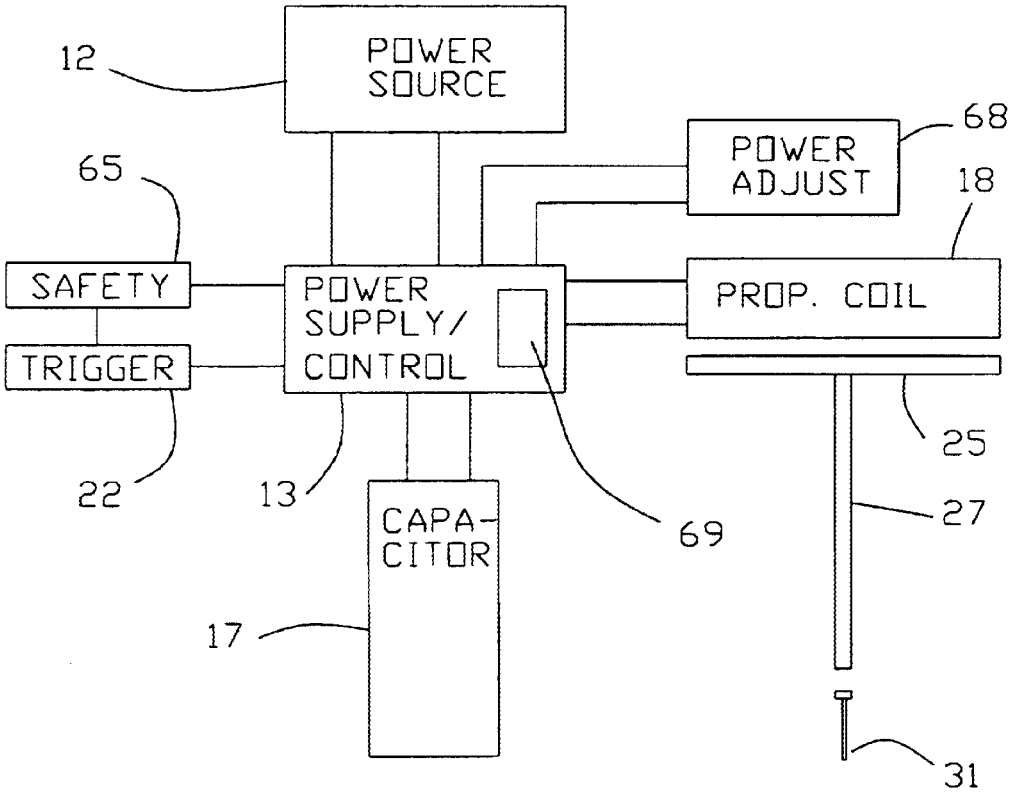
FIG. 3 is a block diagram of an electric circuit for use in the tool of FIG.1.

In FIG. 3, a block diagram of the electrical circuitry for tool 10 is depicted. Several additional elements have been added to tool 10 shown in FIG. 1. A safety switch 66 prevents operation of tool 10 unless workpiece responsive safety element 65 (FIG. 2) is pressed against target material 33 with a suitable threshold force. Finally, a power level adjustment 68 is shown to enable an operator of tool 10 to adjust the drive energy to accommodate a wide range of fasteners. In addition, a microprocessor 69 is shown mounted on power supply/control board 13. The primary function of microprocessor 69 is to control the operation of power supply/control board 13. However, microprocessor 69 may be used to monitor and control many different functions of the operation of tool 10, enhancing its safety and functionality. Several potential uses of microprocessor 69 include: controlling the firing of various components mounted on power supply/control board 13; monitoring temperatures in tool 10 and controlling cooling fan 6; monitoring line voltages and shutting down tool 10 if under or over voltage conditions occur; sensing the presence of a fastener in drive track 29 to prevent dry firing of the tool; identifying size and gauge of a fastener by reading a bar code on the fastener strip and adjusting drive energy appropriately; and permitting operator identification of the medium to adjust the energy level necessary for a proper fastener drive into that medium.

Figure 6:
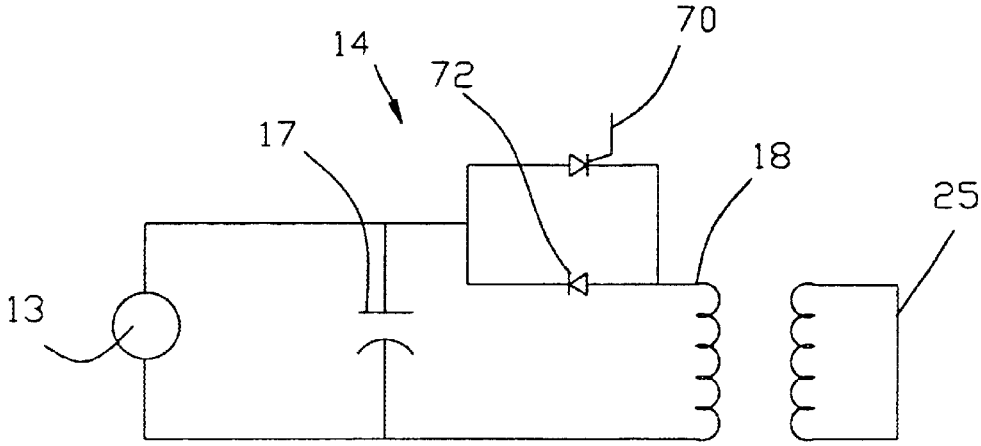
FIG. 6 is an electrical schematic circuit of an embodiment of the present invention.
Figure 7:
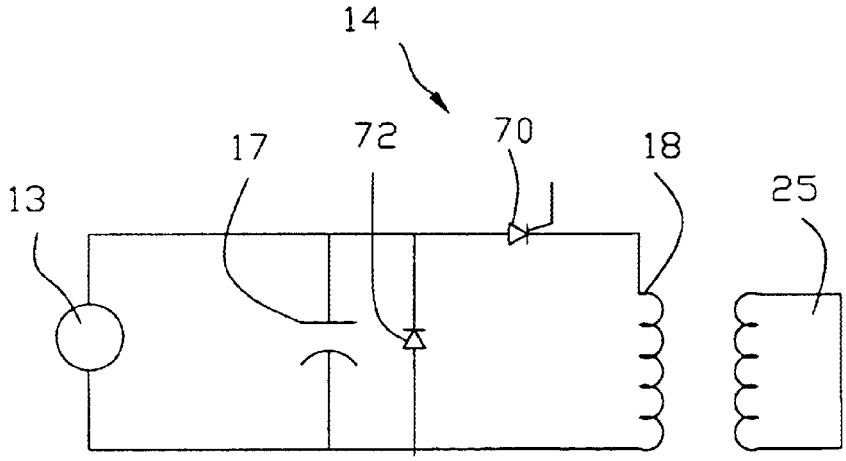
FIG. 7 is an electrical schematic circuit of another embodiment of the present invention.

FIGS. 6 and 7 show different embodiments for the operating circuitry of the present invention. Referring now to FIG. 6, power supply/control board 13, which operates using 120 VAC input a fuel cell, or a DC battery, is coupled to propulsion coil 18 using capacitor 17, which is connected in parallel to power supply/control board 13. One side of coil 18 is connected to capacitor 17 by switch circuit assembly 14. Switch circuit 14 consists of a triggerable normally open switch 70, along with a diode 72 which is connected in the reverse direction in parallel with switch 70. The other side of coil 18 is connected to the opposite side of capacitor 17 and the negative side of power source 12.

The capacitor discharge circuit requires a feed forward switch which has high current carrying capacity, a high rate of turn on (dI/dt), low insertion inductance, such as a thyristor. Switch 70 comprises a MOS controlled thyristor (MCT) in the present embodiment. The MCT is preferably used in a solderable die, and the forward current is only limited by the temperature rise in the die. A size 6 die (approximately 1 cm square) has more than adequate current carrying capacity for the present application. The solderable die packaging permits direct insertion of the MCT onto a printed circuit board, this dramatically reducing the size, insertion inductance, and assembly cost for the switching element. Fast turn on diodes are also available in solderable dies and can be incorporated into a printed circuit board in much the same manner. The combination of the fast switching MCT technology and the solderable dies make the pulse switching orders of magnitude smaller than an equivalent thyristor based conventionally packaged system.

In operation, capacitor 17 stores electrical energy provided from power supply 13 via the capacitor charging circuit. Once capacitor 17 is fully charged, switch 70 is activated, discharging capacitor 17 and its stored energy into coil 18. Switch 70 allows forward current flow, while diode 72 allows reverse current flow back to capacitor 17. This circuit causes the initial capacitively stored energy to flow out of coil 18, repelling piston 23 and causing piston 23 to accelerate, using some of the energy. Diode 72 allows unused energy remaining in coil 18 to flow back to capacitor 17, causing capacitor 17 to partially recharge. This reduces the energy requirement for power supply 13. This circuit design allows for: (1) increased energy efficiency from the overall system (which is an advantage when using a battery); (2) less energy dissipation in coil 18, resulting in less coil heating; and (3) less power supplied through the power supply also resulting in less heat dissipation.

FIG. 7 shows an alternative arrangement for the operating circuitry for the present invention. In this configuration, diode 72 is connected in parallel with capacitor 17 with the cathode connected to the positive terminal of power supply/control 13. Switch 70 is also connected to the cathode side of diode 72. In this circuit, when switch 72 closes, and the energy from capacitor 17 is transferred to coil 18. Effectively, diode 72 traps the energy in coil 18, causing piston acceleration. Capacitor 17 is fully discharged, so that all of the initial energy stored in capacitor 17 is used in accelerating piston, or is dissipated in the circuit components. However, lower efficiency is obtained from this circuit.

The charging system for capacitor 17 is based upon a simple flyback, boost power supply. The input voltage of 110 VAC is rectified and filtered to provide a 50 VAC bus. Capacitor 17 is charged from the DC bus using a flyback circuit employing a single field effect transistor (FET) switch, a transformer, and an output diode. The capacitor charging range is typically 1500 VDC, but is selectable at any value from O to the rating of the capacitors and output switches. The FET is current mode controlled. The FET is turned on and current rises in the primary of the transformer. When a reference current is reached, the FET is turned off and the energy stored in the transformer is transferred to the secondary and output through a diode to capacitor 17. The FET is switched on under the control of a clock, typically at 200 KHZ. Each switching cycle deposits a small increment of energy in capacitor 17 resulting in a rising voltage in capacitor 17. This method of control is referred to as Pulse Current Modulation (PCM).

The reference current signal is provided by microprocessor 69. Microprocessor 69 monitors the voltage at capacitor 17 and adjusts the reference current to achieve the desired rate of charge. When the target charge voltage is reached, the reference current is reduced to zero and charging stops. This approach provides control over the charging rate as well as the charge voltage. PCM control in combination with microprocessor 69 provides protection for the circuit under fault conditions. If the output is disrupted, microprocessor 69 senses that the voltage is not rising as expected (slower for an output short and faster for an open output) and shuts the supply off.

The tool can be operated in either a corded or cordless mode. In a corded mode, AC power is supplied to an input rectifier on board 13 where it is converted to 150 VDC to supply the fly back power supply. The AC supply can be replaced by a battery pack that supplies 150 VDC directly to the rectifier. The rectifier will feed the DC voltage directly to the DC bus permitting the tool to operate in its usual manner. The high voltage DC battery pack can be constructed either with series cells to directly generate the 150 VDC or it can be constructed with low voltage cells (say 18VDC) and a boost converter to output 150VDC.

The boost converter can be built into the tool permitting direct operation from a low voltage battery pack. 120 VAC operation then requires an adapter to bring the AC voltage down to low voltage DC compatible with the boost converter.

Capacitor 17 is preferably a film type capacitor in the present embodiment. Various designs and constructions have been developed recently for the manufacture of capacitors. The current state of the art is such that film type capacitors provide a combination of high energy density, with economical mass manufacturability, along with a robust physical design capable of the rigors of the harsh environment into which this type of tool will be subjected. As film type capacitors currently provide the highest possible energy density, this type of capacitor is the preferred choice for the present invention.

In general, film type capacitors are made by winding very thin films into a continuous roll, very similar to a roll of hand towels. The film, however, is actually comprised of a first layer of conductor and a second layer of insulator/dielectric material. When wound into a roll, the layers alternate between conductive and dielectric. After rolling, depending on the dielectric material used, a liquid dielectric impregnant may be introduced into the roll to enhance the electrical properties of the capacitor. Alternatively, a dry type capacitor that does not employ the dielectric fluid may be desirable for the present embodiment for several reasons, including better durability, no leakage possibility, and no threat to the environment upon disposal. In addition, with the versatility is the construction of this type of capacitor, it may be possible to integrate the capacitor directly into the tool, providing a more compact tool design with better weight balance.

Like most other components, both mechanical and electrical, repeated use results in some degradation in the component performance. In the case of capacitors such as the energy storage capacitors for the present invention, as the capacitor is cycled through charge-discharge-recharge due to repeated use, the capacitor degrades. The degradation results in loss of energy storage capacity at a certain charge voltage. Because fastener drive depth is directly related to energy stored, capacitor degradation can result in unacceptable tool performance. With adequate control capability, capacitor degradation over the tool life can be compensated by appropriately increasing the capacitor charge voltage, thereby maintaining consistent stored/drive energy. The prototype tool employs a microprocessor based control system which can be used to monitor and compensate the charge voltage for capacitor degradation. By actively monitoring/measuring the energy delivered to the capacitor by the charging power supply, microprocessor 69 can accurately and automatically control the stored energy at the preset level.

Figure 8A:
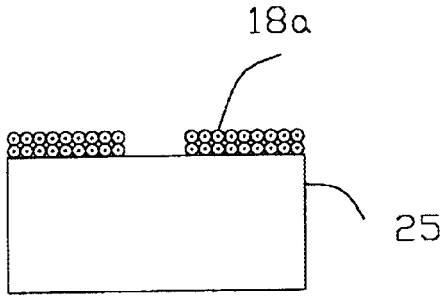
FIGS. 8A–D show several different embodiments of the propulsion coil of the present invention.
Figure 8B:
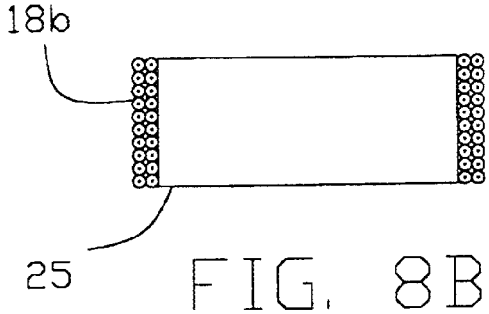
Figure 8C:
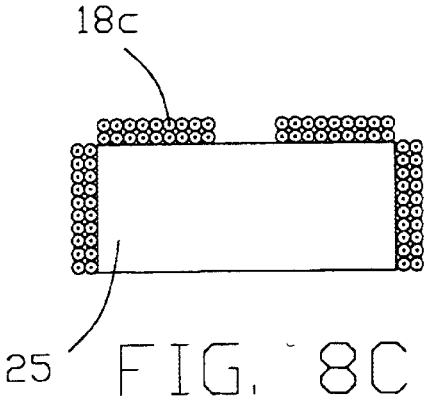
Figure 8D:
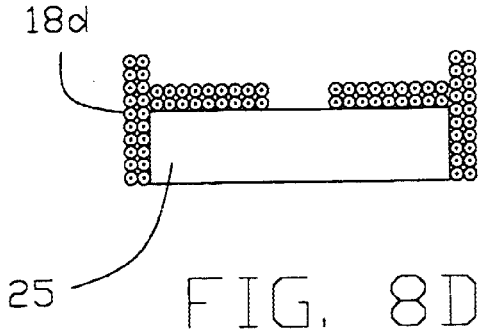

FIGS. 8A–D show several different embodiments of coil 18 windings related to piston for use in the present invention. FIG. 8A shows a device in which coil 18*a* is a "pancake" style coil which is used to inducing current into a round, flat (or tapered) conductive metal piston member 25. The pattern of current flow induced in piston 25 is intended to be a mirror image of coil 18 current, thereby causing a relatively uniform magnetic pressure on the base of the piston. FIG. 8B shows a device in which coil 18*b* surrounds piston in the same manner as a conventional solenoid. FIG. 8C shows a device in which coil 18*c* is wound similar to a cup, which may provide improved efficiency as a result of better magnetic coupling with piston 25. However, this design will have higher resistance than that of FIG. 8A because of a greater number of turns, which has a greater wire length. FIG. 8D shows a coil 18*d* using a variation of the coil of FIG. 8C, which may provide enhanced efficiency and performance over that shown in FIG. 8A.

While this invention has been shown and described in terms of a preferred embodiment, it should be understood that this invention is not limited to this particular embodiment and that any changes and modifications can be made without departing from the true spirit and scope of the invention as defined in the appended claims.

The foregoing description of a preferred embodiment of the invention has been presented for purposes of illustration and description. It is not intended to be exhaustive or limit the invention to the precise form disclosed, and many modifications and variations for the device and types of fasteners driven are possible in light of the above teaching. The embodiment was chosen and described in order to best explain the principles of the invention and its practical application to thereby enable others skilled in the art to best utilize the invention and various embodiments and with various modifications as are suited to the particular use contemplated. It is intended that the scope of the invention be defined by the claims appended hereto.

What is claimed is:

1. A hand held impact device for driving fasteners into a workpiece, comprising:

a piston;

an impact member rigidly fixed to said piston;

a propulsion coil located proximate said piston;

a capacitor electronically coupled to said coil;

control means for transferring said energy from said capacitor to said coil;

a housing for enclosing said piston, coil, capacitor, and control means;

a handle extending from said housing;

a magazine coupled to said housing for carrying a supply of fasteners;

and a trigger switch coupled to said housing for operating said control means;

whereby when said trigger switch is activated, said coil repels said piston and said impact member to drive a fastener from said magazine into a workpiece.

2. The device of claim 1, further comprising a power source for providing energy to said capacitor.

3. The device of claim 2, wherein said power source is located outside of said housing.

4. The device of claim 3, wherein said power source comprises a conventional alternating current source.

5. The device of claim 2, wherein said power source is located within said housing.

6. The device of claim 5, wherein said power source comprises a direct current battery.

7. The device of claim 2, wherein said power source comprises of a fuel cell.

8. The device of claim 1, wherein said capacitor comprises a film type capacitor.

9. The device of claim 1, wherein said piston is composed of a highly conductive non-magnetic material.

10. The device of claim 1, wherein said propulsion coil is wound from wire having a rectangular cross section.

11. The device of claim 1, further comprising a coil housing for retaining said propulsion coil within said housing.

12. The device of claim 11, wherein said coil housing is composed of a plastic material.

13. The device of claim 11, wherein said coil housing is composed of a ceramic material.

14. The device of claim 1, wherein said piston is repelled by said propulsion coil by a Lorentz force generated by said propulsion coil.

15. The device of claim 1, wherein said control means contains a microprocessor.

16. The device of claim 1, wherein said control means contains a thyristor for transferring said energy to said propulsion coil.

17. The device of claim 16, wherein said thyristor comprises a MOS controlled thyristor.

18. The device of claim 1, further comprising cooling means for removing heat from said device.

19. A hand held direct electric propulsion fastener driving tool for driving a fastener into a workpiece, comprising:

a housing;

a cylinder sleeve located within said housing;

a piston slidably contained within said sleeve;

a fastener driving element rigidly affixed to said piston;

a propulsion coil located proximate to said piston;

a capacitor electrically coupled to said coil, for storing electrical energy;

control means for transferring said energy stored in said capacitor to said propulsion coil;

a handle coupled to said housing for positioning said tool against a workpiece;

a trigger switch coupled to said housing for operating said control means;

and means coupled to said housing for holding a plurality of fasteners, wherein when energy stored within said capacitor is transferred to said propulsion coil by said control means, said piston is repelled by said propulsion coil by a Lorentz force generated by said coil within said sleeve, enabling said fastener driving element to drive a fastener out of said tool into a workpiece.

20. The tool of claim 19, further comprising a coil holder mounted within said housing for retaining said propulsion coil in a fixed position proximate said piston.

21. The tool of claim 20, wherein said coil holder is constructed from plastic.

22. The tool of claim 20, wherein said coil housing is composed of a ceramic material.

23. The tool of claim 19, wherein said capacitor comprises a thin film capacitor.

24. The tool of claim 19, wherein said control means includes a thyristor.

25. The tool of claim 24, wherein said thyristor is a MOS controlled thyristor.

26. The tool of claim 19, wherein said fastener holding means comprises a magazine for holding a strip of fasteners.

27. The tool of claim 19, further comprising a fan located within said housing to remove heat from said housing.

28. A method for driving fasteners with a hand held electric fastener driving tool, comprising the steps of:

advancing a fastener from a tool magazine within a drive track of a fastener driving tool;

using the handle of said tool to position the drive track of said tool against a workpiece;

charging a capacitor from a power source such that said capacitor contains electrical energy;

activating a trigger switch to transfer said electrical energy from said capacitor to a propulsion coil;

repelling a piston away from said coil when the electrical energy is transferred from said capacitor to said coil, said piston having a driving element rigidly affixed thereto;

and causing said driving element to impact said fastener within said drive track to expel said fastener from said fastener driving tool into said workpiece.

29. The method of claim 28, wherein said electrical energy transfer is controlled by a control means coupled between said power source and said capacitor.

30. The method of claim 28, wherein said control means includes a thyristor.

31. The method of claim 30, wherein said thyristor is a MOS controlled thyristor.

32. The method of claim 28, wherein said power source comprises a direct current battery contained within said tool.

33. The method of claim 28, wherein said power source comprises an alternating current outlet located outside of said tool.

34. The method of claim 28, wherein said capacitor comprises a film type capacitor.

35. The method of claim 34, wherein said piston is constructed from a highly conductive non-magnetic material.

36. The method of claim 28, wherein said power source comprises a fuel cell.

* * * * *